US009958177B2

(12) United States Patent
Muramatsu

(10) Patent No.: US 9,958,177 B2
(45) Date of Patent: May 1, 2018

(54) HUMAN OCCUPANCY-BASED CONTROL SYSTEM FOR AN AIR CONDITIONING SYSTEM

(71) Applicant: Mitsubishi Electric Corporation, Tokyo (JP)

(72) Inventor: Hiroaki Muramatsu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 393 days.

(21) Appl. No.: 14/595,385

(22) Filed: Jan. 13, 2015

(65) Prior Publication Data

US 2015/0226447 A1 Aug. 13, 2015

(30) Foreign Application Priority Data

Feb. 12, 2014 (JP) ..... 2014-024528

(51) Int. Cl.
*F24F 11/00* (2018.01)
*F24F 3/06* (2006.01)

(52) U.S. Cl.
CPC ..... *F24F 11/0034* (2013.01); *F24F 3/065* (2013.01); *F24F 2011/0064* (2013.01);
(Continued)

(58) Field of Classification Search
CPC .... F24F 11/0012; F24F 11/0034; F24F 3/065; F24F 2011/0063; F24F 2011/0064;
(Continued)

(56) References Cited

U.S. PATENT DOCUMENTS 5,097,672 A 3/1992 Takenaka et al.
5,819,840 A * 10/1998 Wilson ..... G05D 23/1902 165/11.1

(Continued)

FOREIGN PATENT DOCUMENTS

EP 2 058 598 A2 5/2009
EP EP 2058598 A2 * 5/2009 ..... F24F 11/006

(Continued)

OTHER PUBLICATIONS

Office Action dated Feb. 22, 2016 in corresponding Canadian patent application No. 2,877,528.

(Continued)

*Primary Examiner* — Jonathan Bradford
(74) *Attorney, Agent, or Firm* — Posz Law Group, PLC

(57) ABSTRACT

An air conditioning system that includes refrigerant systems respectively including an indoor unit connected to an outdoor unit by a refrigerant pipe, the refrigerant systems being controlled by a remote controller that is provided. The indoor unit includes a human sensor whose power supply operates simultaneously with the indoor unit. When the air conditioning system is in an on-state and detection information of the human sensor indicates absence, the indoor unit transmits an absence signal to the remote controller. The remote controller that has received the absence signal transmits an absence-off period signal including absence-off period control information set in advance to the indoor unit. The indoor unit that has received the absence-off period signal is controlled according to the absence-off period control information.

5 Claims, 6 Drawing Sheets

(52) U.S. Cl.
CPC ..... *F24F 2011/0068* (2013.01); *F24F 2011/0075* (2013.01)

(58) Field of Classification Search
CPC ..... F24F 2011/0065; F24F 2011/0068; F24F 2011/0075
See application file for complete search history.

(56) References Cited

U.S. PATENT DOCUMENTS

| | | | | |
|---|---|---|---|---|
| 8,136,738 | B1 * | 3/2012 | Kopp | F24F 11/0034 165/237 |
| 8,214,084 | B2 * | 7/2012 | Ivey | H05B 33/0803 315/291 |
| 2007/0137225 | A1 | 6/2007 | Shindo et al. | |
| 2011/0173999 | A1 * | 7/2011 | Lord | F24F 3/048 62/89 |
| 2011/0240750 | A1 | 10/2011 | Tokura | |
| 2012/0012297 | A1 * | 1/2012 | Nakagawa | F24F 11/0012 165/247 |
| 2012/0158206 | A1 * | 6/2012 | Longobardi | G05B 13/048 700/300 |

FOREIGN PATENT DOCUMENTS

| | | | |
|---|---|---|---|
| JP | HE12-140548 | A | 5/1990 |
| JP | H11-006644 | A | 1/1999 |
| JP | 2000-240998 | A | 9/2000 |
| JP | 2001-215038 | A | 8/2001 |
| JP | 2007-170686 | A | 7/2007 |
| JP | 2011-214751 | A | 10/2011 |
| JP | 2011-215031 | A | 10/2011 |
| JP | 2012-022626 | A | 2/2012 |
| JP | 2012-057826 | A | 3/2012 |
| JP | 2012-211737 | A | 11/2012 |
| JP | 2013-024463 | A | 2/2013 |
| WO | 2010/079727 | A1 | 7/2010 |
| WO | 2012/007805 | A1 | 1/2012 |

OTHER PUBLICATIONS

Extended European Search Report dated Jun. 19, 2015 issued in corresponding EP patent application No. 15150055.0.
Office Action dated Mar. 28, 2017 in corresponding Japanese patent application No. 2014-024528 (with partial English translation).

* cited by examiner

HUMAN OCCUPANCY-BASED CONTROL SYSTEM FOR AN AIR CONDITIONING SYSTEM

CONTINUITY INFORMATION

This application claims priority to Japanese patent application No. JP 2014-024528, filed on Feb. 12, 2014.

BACKGROUND OF THE INVENTION

1. Field of the Invention

The present invention relates to an air conditioning system.

2. Description of the Related Art

Conventionally, in an air conditioning system mounted with a human sensor, there has been developed an air conditioning system that detects whether or not a person is in a room, and stops the operation of an air conditioner when there is no one in the room, thereby achieving power saving in the entire space to be air-conditioned. In the air conditioning system using such a human sensor, operation control of the air conditioning system is executed automatically based on whether or not a person is in a room, thereby making the system pleasant and efficient for a user.

In the air conditioning system using a plurality of refrigerant systems mounted with a conventional human sensor, that is, in the air conditioning system that includes a plurality of refrigerant systems constituted by one indoor unit and one outdoor unit and operates these units by one remote controller, when the indoor unit is controlled by detecting whether or not a person is in a room by the human sensor, the indoor unit does not operate at all when there is no one in the room. Therefore, when a certain time passes while the indoor unit is in a stopped state, the room temperature deviates from a comfortable temperature range, and even when the air conditioning operation is resumed when a user returns to the room, a certain time is required until the temperature reaches a desired temperature.

Furthermore, when the indoor unit is controlled on the basis of a detection whether or not a person is in a room by the conventional human sensor, if a person hardly moves in a space to be air-conditioned (while the person is sleeping, for example), the indoor unit becomes a stopped state, and the room temperature may largely deviate from a comfortable temperature range.

For example, Japanese Patent Application Laid-open No. H11-6644 discloses an air conditioning system in which in order to provide an air conditioning system that detects presence or absence of a human in each room and automatically controls air conditioning so as to satisfy both of energy saving and comfortableness, a refrigerant pipe is connected between an outdoor heat exchanger and an indoor heat exchanger, and a refrigerant is circulated by a compressor. Cold air or warm air from the indoor heat exchanger is fed out to a duct by an indoor blower, so that conditioned air is guided to each room to be air-conditioned to perform air conditioning. A control unit performs an air conditioning operation according to an air-conditioning condition schedule, and receives a signal from a human sensor and a temperature sensor, respectively, to control an outdoor unit, an indoor unit, and an indoor blower unit. When the human sensor detects presence of a human in a room while air conditioning is set to be off, the control unit controls switchover between cooling and heating so as to achieve a comfortable temperature for human in preference to the air-conditioning condition schedule. On the other hand, when the human sensor detects absence of a human in a room while air conditioning is set to be on, the control unit controls switchover so that a low load operation is performed.

However, according to the conventional technique described above, when a detection result of the human sensor in an off-state of the air conditioning system indicates that a person is in a room, the air conditioning system is turned on, and when the detection result of the human sensor in an on-state indicates that no one is in the room, the air conditioning system performs a low load operation. Therefore, the human sensor needs to maintain the on-state even when the air conditioning system is in the off-state, thereby requiring standby power. Further, because control is executed giving priority to the detection result of the human sensor even in the off-state of the air conditioning system, the air conditioning system operates against user's intention in a case in which a trouble of the human sensor or the like has occurred, thereby deteriorating convenience.

SUMMARY OF THE INVENTION

It is an object of the present invention to at least partially solve the problems in the conventional technology.

To solve the above problems and achieve the object, an air conditioning system according to an aspect of the present invention includes a plurality of refrigerant systems respectively including one indoor unit connected to one outdoor unit by a refrigerant pipe, and controls the plurality of refrigerant systems by one remote controller. The indoor unit includes a human sensor in which a power supply thereof operates simultaneously with the indoor unit, and when the air conditioning system is in an on-state and detection information of the human sensor indicates absence, the indoor unit transmits an absence signal to the remote controller, the remote controller that has received the absence signal transmits the absence-off period signal including absence-off period control information set in advance to the indoor unit, and the indoor unit that has received the absence-off period signal is controlled according to the absence-off period control information.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an air conditioning system according to the present invention will be explained below in detail with reference to the accompanying drawings.

The present invention is not limited to the embodiments.

Embodiment

Figure 1:
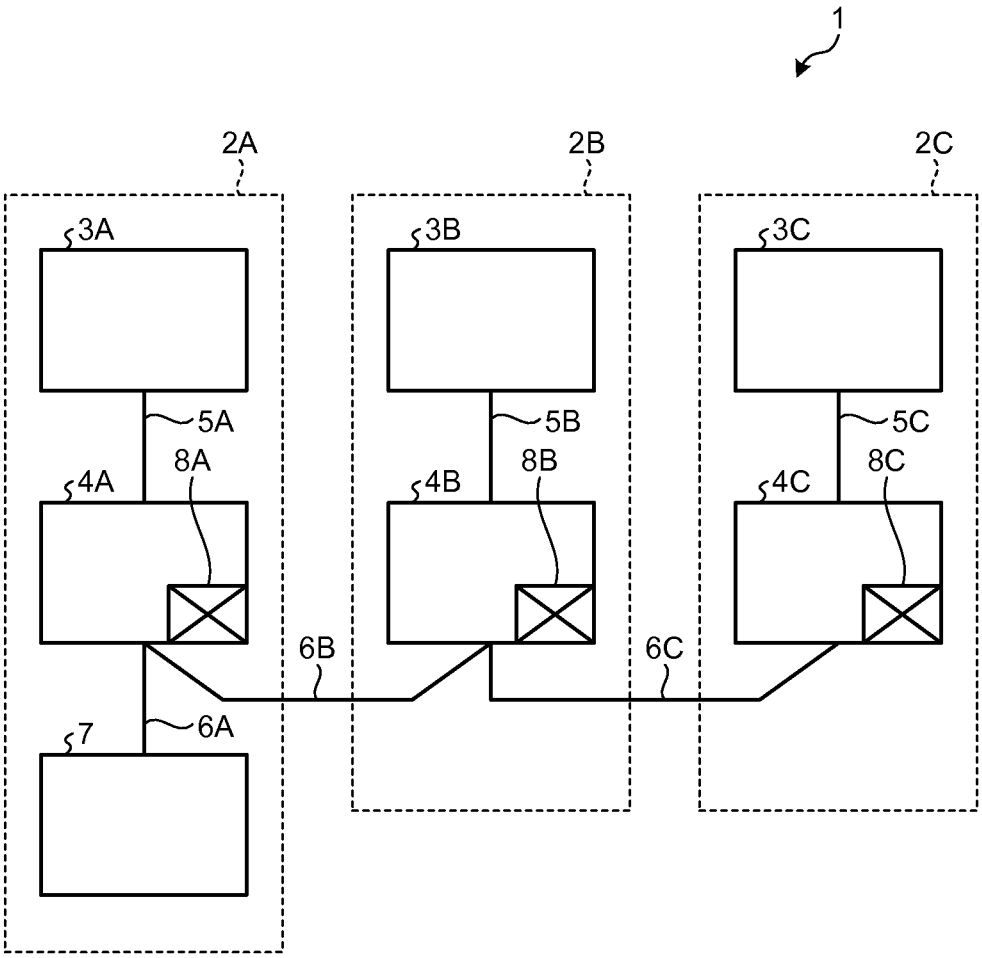
FIG. 1 shows a configuration of an air conditioning system according to an embodiment of the present invention.

FIG. 1 shows a configuration of an air conditioning system according to an embodiment of the present invention. An air conditioning system 1 shown in FIG. 1 includes a plurality of refrigerant systems 2A, 2B, and 2C. In the refrigerant system 2A, an outdoor unit 3A and an indoor unit 4A are connected to each other by a communication line 5A. In the refrigerant system 2B, an outdoor unit 3B and an indoor unit 4B are connected to each other by a communication line 5B, and in the refrigerant system 2C, an outdoor unit 3C and an indoor unit 4C are connected to each other by a communication line 5C.

In the present specification, the refrigerant system refers to a system constituted by one indoor unit and one outdoor unit connected to each other by a refrigerant pipe as one set. The air conditioning system according to the present invention includes a plurality of such refrigerant systems, and it is assumed that the refrigerant pipe in each of refrigerant systems is independent. That is, the outdoor unit 3A and the indoor unit 4A are connected to each other by the refrigerant pipe, the outdoor unit 3B and the indoor unit 4B are connected to each other by the refrigerant pipe, and the outdoor unit 3C and the indoor unit 4C are connected to each other by the refrigerant pipe, and each of the refrigerant pipes is independent of other refrigerant pipes.

A remote controller 7 is connected to the indoor unit 4A by a communication line 6A. The indoor unit 4A and the indoor unit 4B are connected to each other by a communication line 6B, and the indoor unit 4B and the indoor unit 4C are connected to each other by a communication line 6C. Further, a human sensor 8A is mounted on the indoor unit 4A, a human sensor 8B is mounted on the indoor unit 4B, and a human sensor 8C is mounted on the indoor unit 4C. Here it is assumed that the indoor unit 4A is a representative indoor unit in the air conditioning system 1. Control information including detection information of the human sensors 8A to 8C is transmitted to the indoor units 4A to 4C and the remote controller 7 via the communication lines 6A to 6C. Although not shown, the indoor units 4A to 4C are provided with a temperature sensor.

Figure 2A:
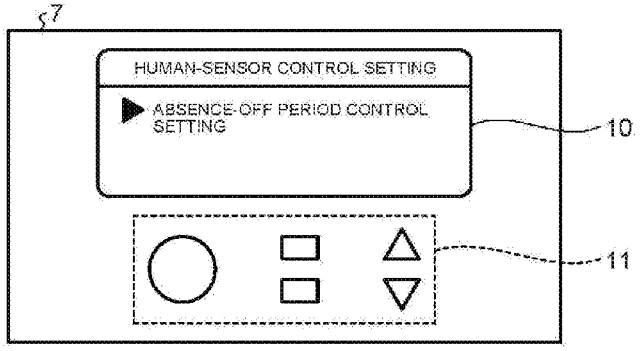
FIGS. 2A to 2C show a control setting screen of a remote controller for explaining a temperature setting method during an off-period due to absence (hereinafter may be referred to just as an "absence-off period") using a human sensor according to the embodiment.
Figure 2B:
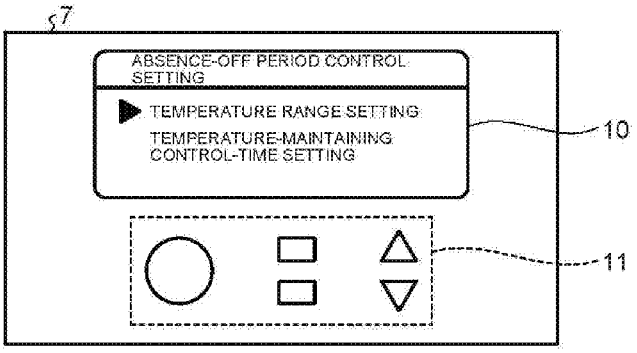
Figure 2C:
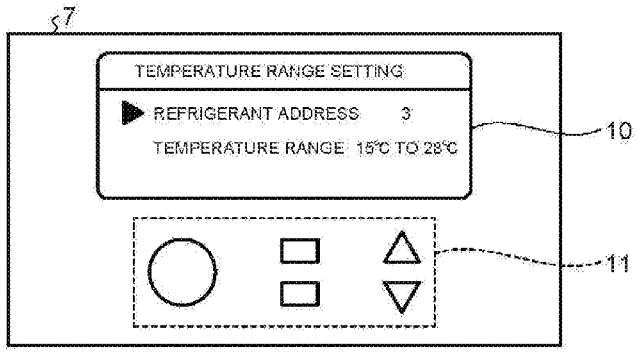

The operation of the air conditioning system 1 is explained next. FIGS. 2A to 2C show a control setting screen of the remote controller 7 for explaining a temperature setting method during an absence-off period using the human sensor according to the embodiment of the present invention. In FIG. 2, the remote controller 7 including a remote controller screen 10 and an operation panel 11 is shown. However, the operation panel 11 may not be provided, and the remote controller screen 10 can be a touch panel.

In FIGS. 2A to 2C, a user selects "absence-off period control setting" in a "human-sensor control-setting" screen (FIG. 2A), selects a "temperature range setting" in the absence-off period control-setting screen (FIG. 2B), and selects a "refrigerant address 3" in the temperature range setting screen, and sets a temperature range at the refrigerant address "3" to 15° C. to 28° C. (FIG. 2C). Set information is stored in a memory in the remote controller 7. The refrigerant address is allocated to each of the refrigerant systems 2A to 2C, and the refrigerant address of the refrigerant system 2A is "1", the refrigerant address of the refrigerant system 2B is "2", and the refrigerant address of the refrigerant system 2C is "3".

Figure 3:
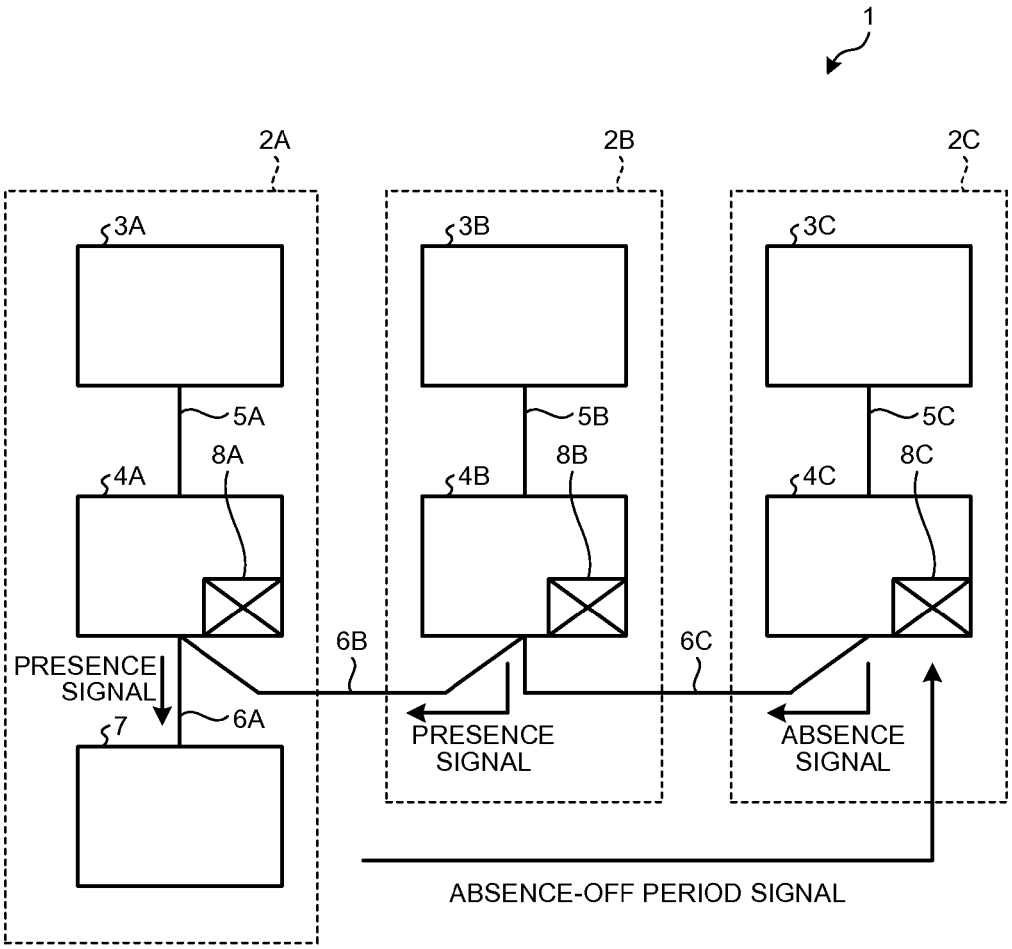
FIG. 3 is an explanatory diagram of transmission and reception of signals between a remote controller and an indoor unit during an operation of the air conditioning system according to the embodiment.

FIG. 3 is an explanatory diagram of transmission and reception of signals between the remote controller and the indoor unit during the operation of the air conditioning system 1 according to the present embodiment. In FIG. 3, a user is present in a space to be air-conditioned of the refrigerant system 2A, a user is present in a space to be air-conditioned of the refrigerant system 2B, and no user is present in a space to be air-conditioned of the refrigerant system 2C. At this time, a "presence signal" is transmitted from the indoor units 4A and 4B to the remote controller 7 according to the detection results of the human sensors 8A and 8B, and an "absence" signal is transmitted from the indoor unit 4C to the remote controller 7 according to the detection result of the human sensor 8C. An "absence-off period" signal is transmitted from the remote controller 7 to the indoor unit 4C to execute absence-off period control.

The "absence-off period" signal refers to a signal transmitted from the remote controller 7 to the indoor units 4A to 4C based on air-conditioning temperature information (temperature information of the space to be air-conditioned and information indicating whether a person is in a room detected by the human sensor) transmitted from the indoor units 4A to 4C, and is a control signal transmitted in order to maintain an "absence-off" state, when the temperature of the space to be air-conditioned is within the temperature range set in FIG. 2C, and transmitted in order to perform an air conditioning operation when the temperature of the space to be air-conditioned is not within the temperature range set in FIG. 2C. That is, the signal includes "absence-off period control information".

For the human sensors 8A to 8C, an infrared sensor can be exemplified. Alternatively, the infrared sensor and an ultrasonic sensor can be used together. The human sensors 8A to 8C only need to have a configuration in which they can decide that no one is in the room when presence of a user cannot be detected, for example, for a predetermined period (for example, for five minutes).

Figure 4:
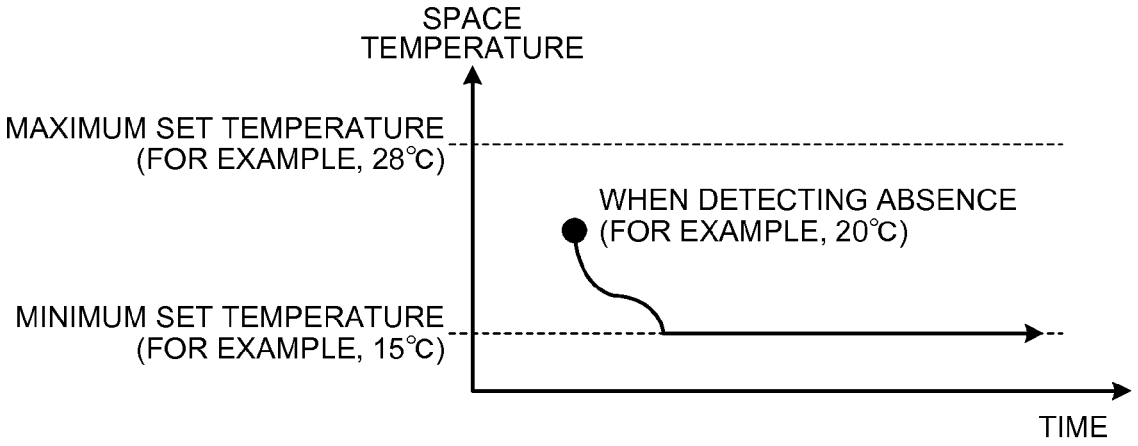
FIG. 4 shows transition of a temperature of a space to be air-conditioned in a space to which the air conditioning system according to the embodiment is applied.

In the air conditioning system according to the present embodiment, control is executed such that the temperature of a space to be air-conditioned does not deviate from a set temperature range. FIG. 4 shows a transition of temperature of a space to be air-conditioned in a space to which the air conditioning system according to the present embodiment is applied. In this way, when the temperature of a space to be air-conditioned has reached a lower limit of the set temperature range, it only has to be controlled so as to maintain the temperature, and when the temperature of the space to be air-conditioned has reached an upper limit of this set temperature range, it only has to be controlled so as to maintain this temperature. Alternatively, the temperature control of the space to be air-conditioned can be started immediately before the temperature of the space to be air-conditioned reaches beyond the temperature range by detecting that the temperature of the space to be air-conditioned is dropping and predicting that the temperature will fall below the temperature range, or by detecting that the temperature of the space to be air-conditioned is increasing and predicting that the temperature will exceed the temperature range.

That is, the indoor unit can be controlled such that when the temperature detected by the indoor unit is at the lower limit of the set temperature range, the lower limit temperature of the temperature range is maintained, and when the temperature detected by the indoor unit is at the upper limit of the set temperature range, the upper limit temperature of the temperature range is maintained.

Alternatively, the indoor unit can be controlled such that a heating operation is started immediately before the temperature detected by the indoor unit drops and falls below the set temperature range to maintain the lower limit temperature of the set temperature range, and that a cooling operation is started immediately before the temperature detected by the indoor unit rises and exceeds the set temperature range to maintain the upper limit temperature of the set temperature range.

By the control operations as described above, the temperature of the space to be air-conditioned falls within the set temperature range. However, the present invention is not limited thereto, and the control of the indoor unit can be started after it is detected that the temperature of the space to be air-conditioned has reached beyond the set temperature range. That is, the indoor unit can be controlled such that when the temperature detected by the indoor unit has fallen below the temperature range, the heating operation is started to maintain the lower limit temperature of the temperature range, and when the temperature detected by the indoor unit has exceeded the temperature range, the cooling operation is started to maintain the upper limit temperature of the temperature range.

By controlling the air conditioning system 1 in this manner, the temperature of the space to be air-conditioned during an absence period can be prevented from deviating from the temperature during the operation of the air conditioning system 1, while suppressing power consumption.

Figure 5A:
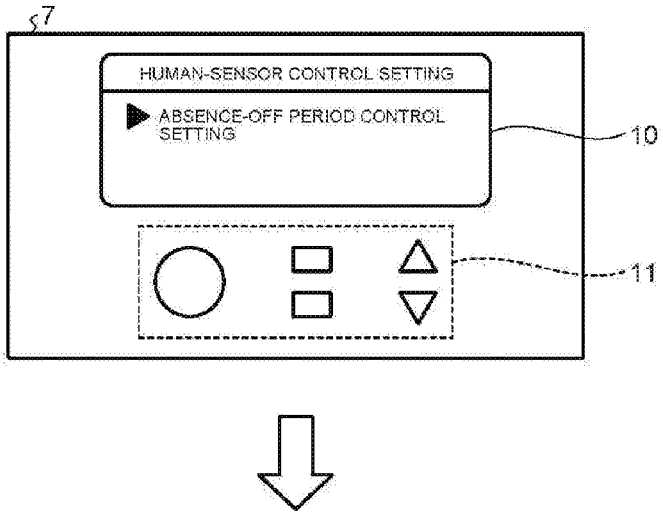
FIGS. 5A to 5C show a remote controller when setting a duration time of space-temperature maintaining control during an absence-off period, in the air conditioning system according to the embodiment.
Figure 5B:
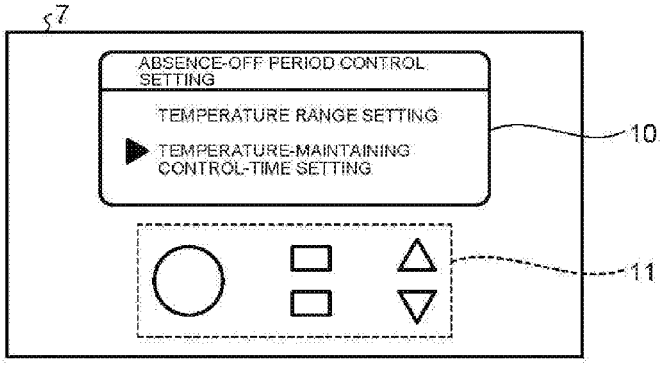
Figure 5C:
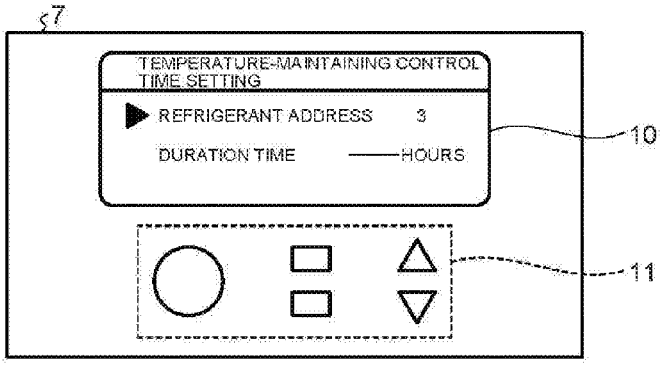

FIGS. 5A to 5C show the remote controller 7 when setting a duration time of space-temperature maintaining control during an absence-off period, in the air conditioning system according to the present embodiment.

FIGS. 5A to 5C show screens when selecting "absence-off period control setting" in the human-sensor control setting screen (FIG. 5A), when selecting "temperature-maintaining control time setting" in the absence-off period control setting screen (FIG. 5B), and when selecting refrigerant address "3" on a temperature-maintaining control time setting screen and setting a duration time of control of the refrigerant address "3" (FIG. 5C). By setting the temperature-maintaining control time in this manner, control is executed such that the temperature in the space to be air-conditioned is maintained within the set temperature range until the set time, and air conditioning is turned off after the set time has passed. When the duration time is not set, such setting can be used that the control for maintaining the space temperature is continued without any limitation of time.

Figure 6:
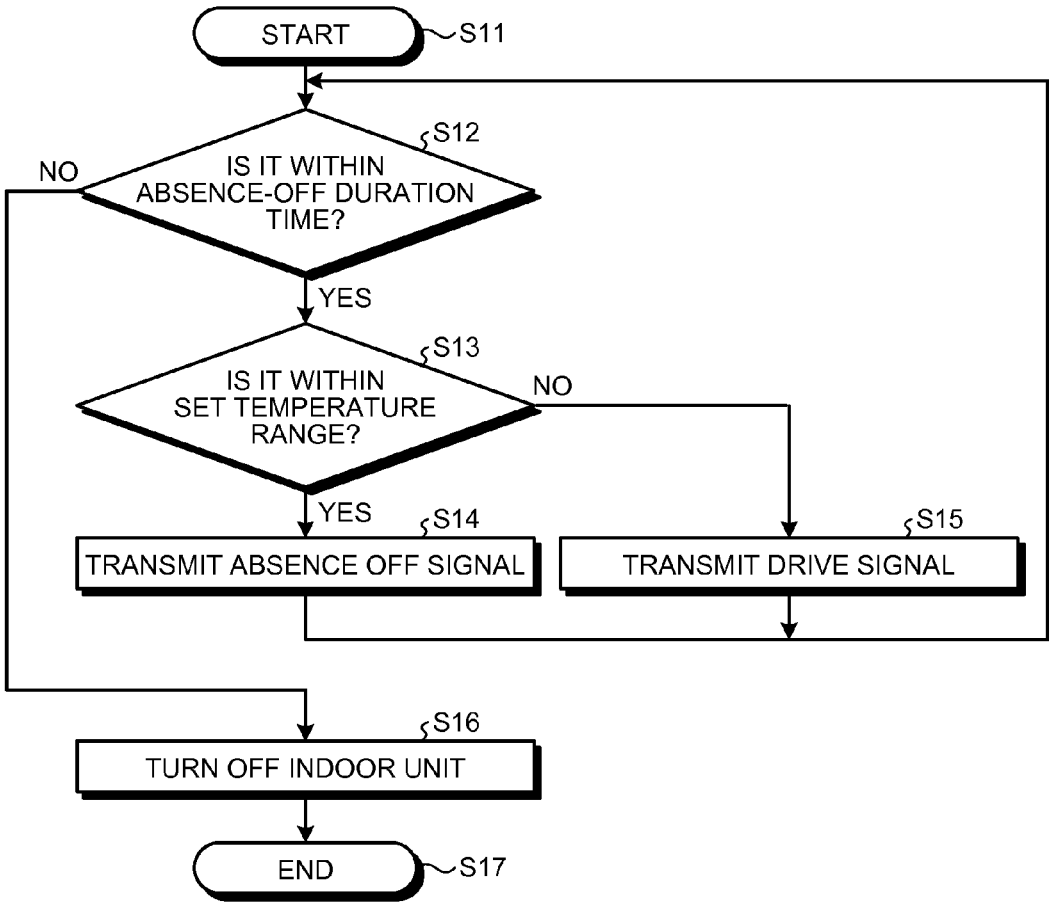
FIG. 6 is a flowchart showing a procedure of control for maintaining a space temperature during an absence-off period of the air conditioning system according to the embodiment.

FIG. 6 is a flowchart showing a procedure of control for maintaining a space temperature during an absence-off period of the air conditioning system according to the present embodiment. Here the refrigerant system 2C is explained. The process is started during the absence-off period (Step S11) to determine whether it is within a set absence-off period control-duration time by the remote controller 7 (Step S12).

As a result of the determination at Step S12, when the current time is outside the absence-off period control-duration time set by the remote controller 7 (when the determination result at Step S12 is NO), the remote controller 7 transmits a turn-off signal to the indoor unit 4C (Step S16). Processing then ends (S17).

As a result of the determination at Step S12, when the current time is within the absence-off period control-duration time set by the remote controller 7 (when the determination result at Step S12 is YES), the space temperature detected by the indoor unit 4C is transmitted to the remote controller 7 to determine whether or not the temperature is within the set temperature range in the absence-off period control setting by the remote controller 7 (Step S13).

As a result of the determination at Step S13, when the space temperature detected by the indoor unit 4C is not within the temperature range set in the absence-off period control setting set by the remote controller 7 (when the determination result at Step S13 is NO), the remote controller 7 transmits a turn-on signal (a drive signal) to the indoor unit 4C so that the space temperature detected by the indoor unit 4C falls within the temperature range (Step S15). The control process returns to Step S12 at which the remote controller 7 determines again whether the current time is within the set absence-off period control-duration time (Step S12).

As a result of the determination at Step S13, when the space temperature detected by the indoor unit 4C is within the temperature range set in the absence-off period control setting set by the remote controller 7 (when the determination result at Step S13 is YES), the remote controller 7 transmits an absence-off signal to the indoor unit 4C (Step S14). The control process returns to Step S12 at which the remote controller 7 determines again whether the current time is within the set absence-off period control-duration time (Step S12). The indoor unit 4C to which the absence-off signal is transmitted is controlled such that the temperature becomes within the set temperature range as shown in FIG. 4.

As explained above, according to the present embodiment, in the air conditioning system including a plurality of refrigerant systems, even if the indoor unit is in an absence-off period, the space temperature is maintained by the human sensor at a comfortable temperature for each refrigerant system.

Further, according to the present embodiment, an air conditioning system that gives priority to user's intention while suppressing standby power can be obtained, as described below.

Table 1 shows an operation of an air conditioning system in accordance with air conditioning setting and detection information of a human sensor.

TABLE 1

| Air conditioning setting | Human sensor | |
|---|---|---|
| | Present | Absent |
| On | Air conditioning operation | Absence-off period control |
| Off | | Off |

As shown in Table 1, when the human sensor has detected that a user is present in an area to be air-conditioned in a state in which the air conditioning system is on, the air conditioning system performs an air conditioning operation in accordance with the operation of a remote controller. When the human sensor has detected that a user is absent in the area to be air-conditioned (that is, when the human sensor does not detect the presence of the user in the area to be air-conditioned) in a state in which the air conditioning system is on, as described above, the air conditioning system performs the air conditioning operation according to absence-off period control set in advance. In a state in which the air conditioning system is off, because the human sensor is also off, the off-state is maintained regardless of the detection information of the human sensor. In this example, the operation during the absence-off period is an operation with power consumption being suppressed, which is performed with a low load in order to maintain the set temperature range, as explained above with reference to FIG. 4.

In the conventional air conditioning system, the low load operation is performed in an on-state and also when the user is absent, and the air conditioning operation is performed with the same setting even when the user is present in the room, regardless of on or off of the air conditioning system. In such an air conditioning system, even when the indoor unit is in an off-state, the human sensor maintains an on-state, and thus it is difficult to suppress standby power. Further, in such an air conditioning system, control is executed, giving priority to the detection result of the human sensor, even when the air conditioning system is in the off-state. Therefore, when the human sensor has a trouble, the air conditioning system performs an operation against the intention of a user who has set the air conditioning system to the off-state, thereby deteriorating the convenience.

As explained above, the air conditioning system according to the present embodiment includes a plurality of refrigerant systems respectively including one indoor unit connected to one outdoor unit by a refrigerant pipe, and controls the plurality of refrigerant systems by one remote controller, wherein the indoor unit includes a human sensor in which a power supply thereof operates simultaneously with the indoor unit, and when the air conditioning system is in an on-state and detection information of the human sensor indicates absence, the indoor unit transmits an absence signal to the remote controller, the remote controller, which has received the absence signal transmits the absence-off period signal including absence-off period control information set in advance to the indoor unit, and the indoor unit that has received the absence-off period signal is controlled according to the absence-off period control information. Accordingly, an air conditioning system that gives priority to user's intention can be obtained, while suppressing standby power. Note that regarding the human sensor in which the power supply thereof operates simultaneously with the indoor unit, when the indoor unit is turned on, the human sensor is also turned on, and when the indoor unit is turned off, the human sensor is also turned off.

According to the present embodiment, even when a person hardly moves in a space to be air-conditioned (while the person is sleeping, for example), by maintaining the air conditioning system in an on-state, even when the human sensor detects absence, the temperature in the space to be air-conditioned can be maintained within a set temperature range.

Furthermore, as described in the present embodiment, when each of the plurality of refrigerant systems is independent of one another, the refrigerant system is not affected by operations of other refrigerant systems, and each of the refrigerant systems can be controlled independently.

According to the present invention, an air conditioning system that includes a plurality of refrigerant systems and operates based on a detection result of a human sensor, and that gives priority to user's intention while suppressing standby power can be obtained.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An air conditioning system comprising a plurality of refrigerant systems respectively including one indoor unit connected to one outdoor unit by a refrigerant pipe, and configured to control the plurality of refrigerant systems by one remote controller, wherein the indoor unit includes a human sensor and a power supply, the power supply being configured to power both the human sensor and the indoor unit, the indoor unit is configured to transmit an absence signal to the remote controller when the air conditioning system is in an on-state and detection information of the human sensor indicates absence, the remote controller that has received the absence signal is configured to transmit an absence-off period signal including absence-off period control information set in advance to the indoor unit, and the indoor unit that has received the absence-off period signal is configured to be controlled according to the absence-off period control information, wherein the human sensor in each of the indoor units is configured to turn off when a corresponding indoor unit is turned off.

2. The air conditioning system according to claim 1, wherein the absence-off period control information includes information of a temperature range set in advance, and the air conditioning system is configured such that a lower limit temperature of the temperature range is maintained when a temperature detected by the indoor unit is at a lower limit of the temperature range, and is configured such that an upper limit temperature of the temperature range is maintained when a temperature detected by the indoor unit is at an upper limit of the temperature range.

3. The air conditioning system according to claim 1, wherein the absence-off period control information includes information of a temperature range set in advance, and the air conditioning system is configured such that a heating operation is started immediately before a temperature detected by the indoor unit drops and falls below the temperature range, so as to maintain a lower limit temperature of the temperature range, and the air conditioning system is configured such that a cooling operation is started immediately before a temperature detected by the indoor unit rises and exceeds the temperature range, so as to maintain an upper limit temperature of the temperature range.

4. The air conditioning system according to claim 1, wherein the absence-off period control information includes information of a temperature range set in advance, and the air conditioning system is configured such that a heating operation is started when a temperature detected by the indoor unit falls below the temperature range, so as to maintain a lower limit temperature of the temperature range, and the air conditioning system is configured such that a cooling operation is started when a temperature detected by the indoor unit exceeds the temperature range, so as to maintain an upper limit temperature of the temperature range.

5. The air conditioning system according to claim 1, wherein the absence-off period control information includes an absence-off period control-duration time which is a period during which an operation is performed according to absence-off period control, and the indoor unit is configured to be controlled according to the absence-off period control information within the absence-off period control-duration time, and the indoor unit is configured such that after the absence-off period control-duration time has passed, the indoor unit is turned off.

* * * * *